US005204695A

United States Patent [19]

Tokunaga et al.

[11] Patent Number: 5,204,695

[45] Date of Patent: Apr. 20, 1993

[54] INK JET RECORDING APPARATUS UTILIZING MEANS FOR SUPPLYING A PLURALITY OF SIGNALS TO AN ELECTROMECHANICAL CONVERSION ELEMENT

[75] Inventors: Tatsuyuki Tokunaga; Jiro Moriyama; Makoto Aoki, all of Yokohama; Ikumasa Ikeda, Kawasaki, all of Japan

[73] Assignee: Canon Kabushiki Kaisha, Tokyo, Japan

[21] Appl. No.: 733,013

[22] Filed: Jul. 19, 1991

Related U.S. Application Data

[63] Continuation of Ser. No. 652,370, Feb. 7, 1991, abandoned, which is a continuation of Ser. No. 501,435, Mar. 22, 1990, abandoned, which is a continuation of Ser. No. 182,226, Apr. 15, 1988, abandoned.

[30] Foreign Application Priority Data

Apr. 17, 1987 [JP] Japan ..... 62-94566
Dec. 17, 1987 [JP] Japan ..... 62-319695

[51] Int. Cl.[5] ..... B41J 2/045
[52] U.S. Cl. ..... 346/140 R
[58] Field of Search ..... 346/140

[56] References Cited

U.S. PATENT DOCUMENTS

| | | | |
|---|---|---|---|
| 4,104,646 | 8/1978 | Fischbeck | 346/140 |
| 4,112,433 | 9/1987 | Vernon | 346/140 X |
| 4,352,114 | 9/1982 | Kyogoku | 346/140 |
| 4,369,455 | 1/1983 | McConica et al. | 346/140 R |
| 4,409,596 | 10/1983 | Ishii | 346/140 X |
| 4,424,520 | 1/1984 | Matsuda | 346/140 |
| 4,491,851 | 1/1985 | Mizuno | 346/140 X |
| 4,523,201 | 6/1985 | Liker | 346/140 X |
| 4,563,689 | 1/1986 | Murakami | 346/140 X |
| 4,639,735 | 1/1987 | Yamamoto | 346/140 X |

FOREIGN PATENT DOCUMENTS 103854 6/1982 Japan .

*Primary Examiner*—Joseph W. Hartary

[57] ABSTRACT

An ink jet recording apparatus includes a recording head having a liquid path and a discharge part for discharging ink therethrough, an electromechanical conversion element and a control device. The electromechanical conversion element is correspondingly provided on the liquid path for effecting ink discharge. The control device controls the element by performing a first step of applying a pre-electrical signal to the element, a second step performed after the first step, of applying a main electrical signal, and a third step of applying a subsequent electrical signal to the element before the voltage of the main electrical signal reaches zero. The pre-electrical signal is applied to the element in a direction opposite that which will discharge ink. The second step applies the main electrical signal to the element in the direction of ink discharge for discharging ink in accordance with a recording signal. The third step, performed after ink is discharged by the second step, applies a sub-electrical signal to the element in the direction of ink discharge to prevent meniscus retraction. The sub-electrical signal smoothly changes and quickly attenuates vibration of meniscus caused by drive of the element by the main electrical signal.

3 Claims, 9 Drawing Sheets

| Fig. 8A |
| --- |
| Fig. 8B |

| Fig. 12A |
| --- |
| Fig. 12B |

INK JET RECORDING APPARATUS UTILIZING MEANS FOR SUPPLYING A PLURALITY OF SIGNALS TO AN ELECTROMECHANICAL CONVERSION ELEMENT

This application is a continuation of application Ser. No. 07/652,370 filed Feb. 7, 1991, now abandoned, which in turn is a continuation of application Ser. No. 07/501,435 filed Mar. 22, 1990, now abandoned, which in turn is a continuation of application Ser. No. 07/182,226 filed Apr. 15, 1988, now abandoned.

BACKGROUND OF THE INVENTION

1. Field of the Invention

This invention relates to an ink jet recording method and an ink jet recording apparatus in which ink is discharged to thereby accomplish recording, and in particular, to an ink jet recording method and an ink jet recording apparatus in which pressure is imparted to ink in a liquid path by vibration of an electromechanical conversion element and ink droplets are discharged from an orifice communicating with said liquid path.

2. Related Background Art

FIG. 1 of the accompanying drawings is a schematic front view showing an example of an ink jet printer constructed by the use of an ink jet recording head.

In FIG. 1, a platen 7 is rotatively driven in conformity with the printing situation by a line feed motor 2 which is a pulse motor, and conveys recording paper, not shown, in the circumferential direction thereof. The presence of this recording paper is detected by a paper sensor 4. An ink jet recording head (hereinafter simply referred to as the recording head) 3 is constructed of a plurality of liquid paths 30 communicating with discharge ports for discharging ink therethrough to effect ink injection, and is provided on a carriage slidably provided on a guide bar, not shown, and is moved along the platen 7 through a belt 6 by the drive of a carriage motor 5 comprising a DC motor. A linear encoder 8 and an encoder sensor 9 are provided to effect the detection of the position of the recording head 3 in that case, and a home position sensor 10 is provided to effect the detection of the home position. Also, an ink sucking cap 12 movable by the drive of an auto cap motor 11 is provided to recover the liquid paths 30 of the recording head 3 from their unsatisfactory ink droplet injection, and the operative position of the cap 12 is detected by a cap sensor 13.

Control of the ink jet printer of such construction is effected by a conventional CPU (central processing unit) 20 in the construction of a control system shown in FIG. 2 of the accompanying drawings.

A group of switches 21 and a group of sensors 25 and in addition, the encoder sensor 9 and the home position sensor 10 are connected to the input portion of the CPU 20, and a DC servo reversing circuit 22 for driving the carriage motor 5, a pulse motor driving circuit 23 for driving the line feed motor 2 and a head driver 24 for driving the recording head 3 are connected to [he output portion of the CPU 20. Also, a memory 26 storing record data therein is connected to the CPU 20 through a bus line.

The CPU 20 executes the following control in response to an operation input effected by the group of switches 21, for example, switches or the like provided on an operating panel (not shown). That is, the CPU 20 refers to the input from the encoder sensor 9 and the home position sensor 10, controls the drive of the carriage motor 5 through the DC servo reversing circuit 22, controls the drive of the line feed motor 2 through the pulse motor driving circuit 23, outputs the record data D from the memory 26 to the head driver 24 as pulse generating means, and drives the recording head 3 by the head driver 24. The CPU 20 also effects the control of other mechanisms, not shown, in response to the input from another group of sensors 25 such as ambient temperature sensors.

Under such a construction, the recording operation is started by a print switch in the group of switches 21 being closed. The presence of recording paper is first confirmed by the paper sensor 4, whereafter the line feed motor 2 is driven by several steps to rotate the platen 7 and the recording paper is set at the recording start position. Subsequently, the carriage motor 5 is driven to reciprocally move the recording head 3, and in synchronism therewith, the line feed motor 2 is driven to feed the recording paper line by line. In the meantime, a drive signal conforming to the record data is applied from the head driver 24 to the recording head 3, whereby the recording head 3 is driven and ink droplets are injected from the liquid paths 30 and thus, characters or images are recorded.

FIG. 3 of the accompanying drawings is a schematic cross-sectional view showing the structure of the liquid path 30 of the recording head 3.

The fore end portion of a liquid path body 31 forming a pipe-like shape and into which the ink is introduced is formed into a conical shape and is provided with a discharge port 31*a* as an opening for discharging ink droplets therethrough. The surface of the ink 35 which is exposed to the outside through this discharge port 31*a* becomes concave meniscus M.

Also, a cylindrical piezo-electric element 32 which is an electro-mechanical conversion element for producing discharge pressure for ink droplets and which has electrodes 36 and 37 on the inner and outer peripheral surfaces thereof is fitted to the outer surface of the central portion of the liquid, path body 31, and is adhesively secured to the outer surface in a completely integral state with respect to the liquid path body without leaving any gap therebetween, by an adhesive agent such as epoxy resin.

Further, a filter 34 is fixedly fitted to the vicinity of the open rear end of the liquid path body 31. The filter 34 has the functions of cutting off dust and like foreign materials in the ink 35 flowing to the left as indicated by the arrow from the rear end of the liquid path body 31 and supplied to the orifice leading to the liquid paths, and taking the acoustic impedance to a sound wave produced in the liquid path body 31 during the driving of the piezo-electric element 32 which will be described hereinbelow, at the fore end side and the rear end side of the liquid path.

The piezo-electric constant of such a piezoelectric element 32 is, e.g. about $-300\times10$ m/v with respect to a certain direction and about $600\times10$ m/v with respect to another direction, and thus, a very high piezo-electric property is exhibited.

FIG. 4 of the accompanying drawings shows the wave forms of driving voltages applied to the piezo-electric element 32 by the head driver 24. A driving voltage V1 in the opposite direction to the polarization of the piezo-electric element 32 is imparted, whereby the piezo-electric element 32 is expanded and the amount of ink in the liquid path increases (before the application of the voltage, the liquid path is filled with ink through the filter 34). When a driving voltage V2 is then imparted in the direction of polarization, the piezo-electric element 32 contracts, whereby a pressure wave is produced. This pressure wave propagates through the ink 35 at a speed of about 1,200 m/s-1,500 m/s. By the combined effect of the contraction of the piezo-electric element 32 and the propagation of the pressure wave, an ink droplet is discharged from the discharge port 31*a*. In FIG. 4, P indicates the direction of polarization and $P_O$ indicates the direction opposite to the polarization. This also holds true in FIGS. 6 and 10 of the accompanying drawings.

FIG. 5 of the accompanying drawings shows a variation in the amount of retraction of meniscus resulting from vibration of the piezo-electric element. The amount of retraction $M_R$ of meniscus becomes greatest after the discharge of an ink droplet, whereafter it becomes a vibration attenuated by the influences of the force of restitution and the pressure wave produced by the aforedescribed contraction of the piezo-electric element 32.

However, when the peak of the vibration of meniscus is great, there has been the undesirable possibility of the ink leading from the discharge port 31*a* at the depending portion of time t1 and conversely, there has been the undesirable possibility of a bubble entering into the liquid path at the intermediate residing portion of time t2. Accordingly, it has been difficult in some cases to obtain images of stable and good quality by the use of the conventional driving wave form shown in FIG. 4.

To eliminate such an inconvenience, U.S. Pat. No. 4,112,433 (Vernon) and U.S. Pat. No. 4,101,646 (Fischbeck) have been proposed. These constructions are such that a main pulse is first applied and then a sub-pulse is applied in a predetermined time. An attempt has been made to attenuate the amplitude of the vibration of meniscus by such constructions to thereby prevent bubbles from entering into the liquid path as much as possible.

Also, U.S. Pat. No. 4,409,596 (Ishii) has proposed such a construction that a driving signal comprising two pulses is applied to the recording head. One of the two pulses is a main pulse for discharging ink which is generated with a predetermined delay with respect to a timing pulse synchronized with the movement of the carriage, and the other pulse is a pulse for not discharging ink which is generated before the main pulse is generated, and the timing thereof can be shifted to vary the interval thereof with respect to the main pulse. The initial driven state of the meniscus in the liquid path is dynamically stabilized by the first pulse, and an ink droplet is stably injected by the subsequent main pulse. At this time, by shifting the timing of the first pulse, the state of the meniscus during the application of the main pulse can be varied, whereby the volume of ink can be varied with a result that harmony could be changed.

However, in the conventional ink jet recording apparatus, vibration of meniscus could not be appropriately suppressed simply by applying a predetermined sub-pulse.

That is, the viscosity of the ink varies with a variation in temperature and therefore, even if there is no variation in the driving voltage, meniscus varies in conformity with temperature. Accordingly, the volume of the ink droplet discharged varies, and this has led to the problem that stable recording cannot be accomplished.

Also, there has occured the problem that it is difficult to correct the timing of the first pulse in conformity with a variation in the volume of ink and the circuit therefor is complex in construction. Further, when the main pulse is to be generated with a predetermined delay from a predetermined timing pulse synchronized with the movement of the carriage, there has occurred the inconvenience that when the recording head is reciprocally driven, there must be provided a circuit for correcting the point at which an ink droplet is shot on a recording medium.

In addition, the amplitude of the meniscus vibration after the discharge of an ink droplet is varied by temperature and therefore, depending on the temperature condition, leakage of excess ink or entry of bubbles into the liquid path has occurred and the time required for the meniscus to restore its steady state has become long in some cases.

SUMMARY OF THE INVENTION

It is an object of the present invention to solve such problems peculiar to the prior art and to provide an ink jet recording method in which the time required for meniscus to restore its steady state can be shortened to thereby improve the frequency characteristic of ink injection and an ink jet recording apparatus using such method.

It is another object of the present invention to provide an ink jet recording method which can accomplish stable recording even if the ambient temperature changes and an ink jet recording apparatus using such method.

It is still another object of the present invention to provide an ink jet recording apparatus in which a pulse is applied to an electro-mechanical conversion element provided correspondingly to a liquid path to thereby discharge ink from a discharge port communicating with said liquid path to thereby accomplish recording, characterized by: pulse generating means for generating a main pulse for causing the ink to be discharged and a sub-pulse subsequent to said main pulse; and pulse control means for controlling the ratio of the magnitudes of said main pulse and said sub-pulse.

It is still another object of the invention to provide an ink jet recording method in which a pulse is applied to an electro-mechanical conversion element provided correspondingly to a liquid path to thereby discharge ink from a discharge port communicating with said liquid path to thereby accomplish recording, characterized by the steps of generating a main pulse for causing the ink to be discharged and a sub-pulse subsequent to said main pulse; and controlling the ratio of the magnitudes of said main pulse and said sub-pulse.

According to the present invention, the sub-pulse generated subsequently to the main pulse is applied as voltage in the direction of polarization to a piezoelectric element to contract the piezo-electric element and suitable pressure can be applied in a direction to decrease the amount of displacement of meniscus. Therefore, there can be constructed an ink jet recording apparatus in which the peak value of meniscus vibration is minimized.

Further, according to the present invention, appropriate pressure can be applied in a direction to decrease the amount of displacement of meniscus, in conformity with the amount of displacement of meniscus and therefore, there can be constructed an ink jet recording apparatus in which the sub-pulse does not adversely affect the meniscus.

DESCRIPTION OF THE PREFERRED EMBODIMENTS

The first embodiment of the present invention will hereinafter be described specifically with reference to FIGS. 6, 7 and 8.

Figure 6:
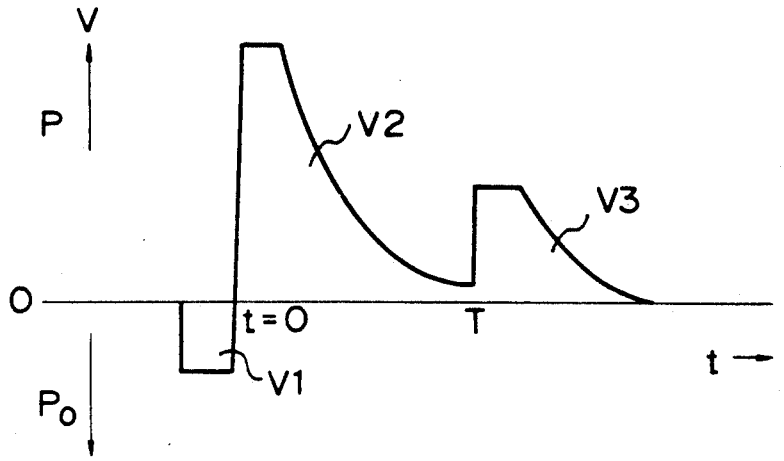
FIG. 6 shows the wave forms of driving voltages for the piezo-electric element produced by the process of the present invention.

FIG. 6 shows the wave forms of driving voltages for a piezo-electric element produced by the process of the present embodiment.

Figure 4:
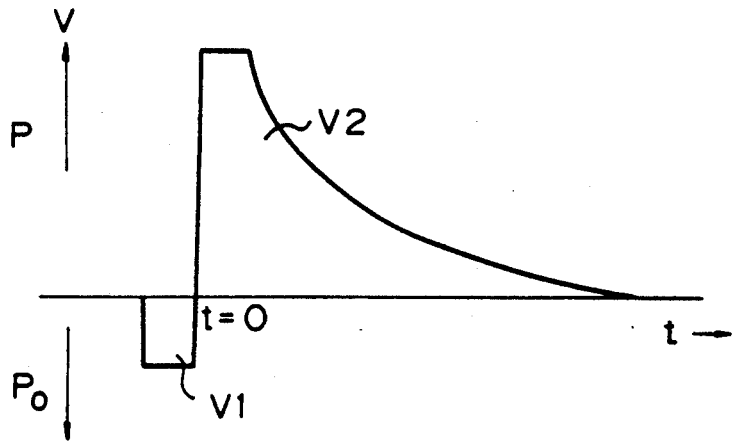
Fig. 4 PRIOR ART
FIG. 4 shows the wave forms of conventional driving voltages for a piezo-electric element.

As shown in FIG. 6, in the present invention, there is adopted a construction in which subsequent to the wave form V2 of the driving voltage of FIG. 4, a wave form V3 is produced and a piezo-electric element 32 is driven by a driving voltage comprising these three wave forms.

Figure 5:
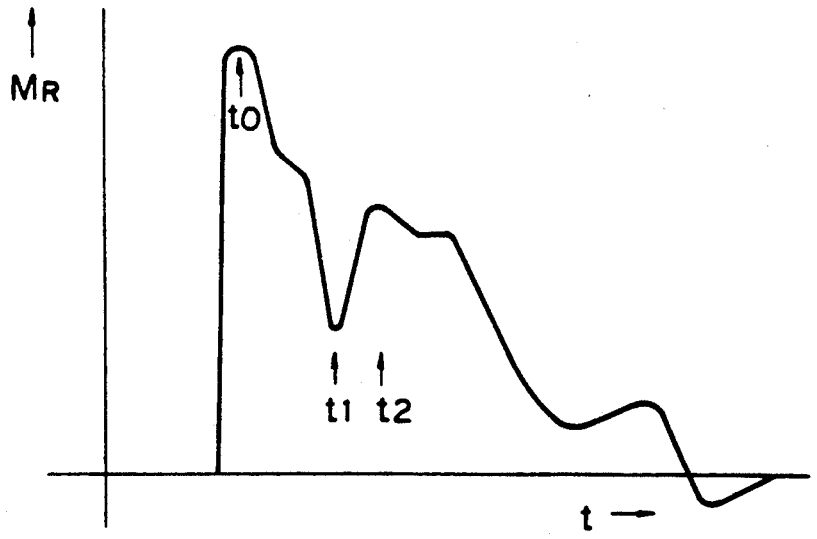
Fig. 5 PRIOR ART
FIG. 5 shows a variation in the amount of retraction of meniscus resulting from the vibration of the piezo-electric element excited by the driving voltages of FIG. 4.

The wave form V3 is produced at the timing of a time T, and this time T is set immediately before a time t0 when meniscus retracts most in the meniscus vibration of FIG. 5, and the peak value thereof is a value smaller than or equal to the wave form V2.

Figure 7:
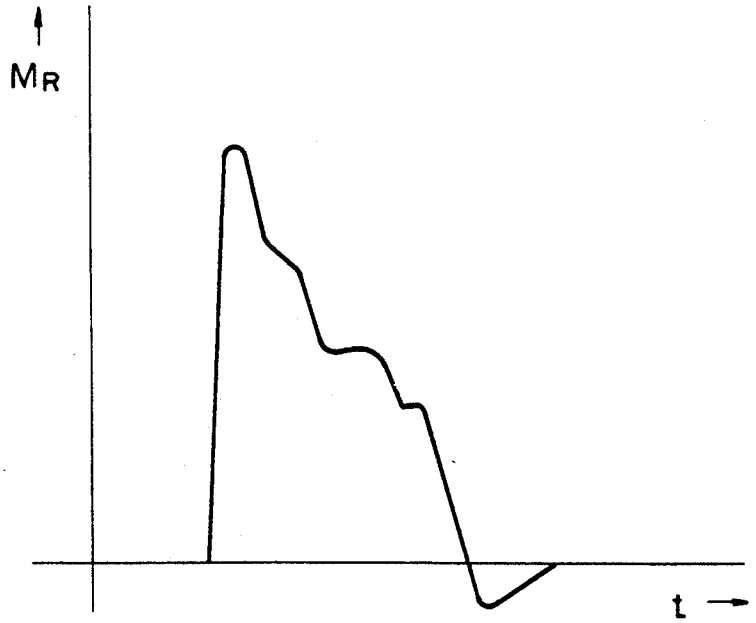
FIG. 7 shows a variation in the amount of retraction of meniscus when the piezo-electric element is driven by the driving voltages of FIG. 6.
Figures 8, 8A:
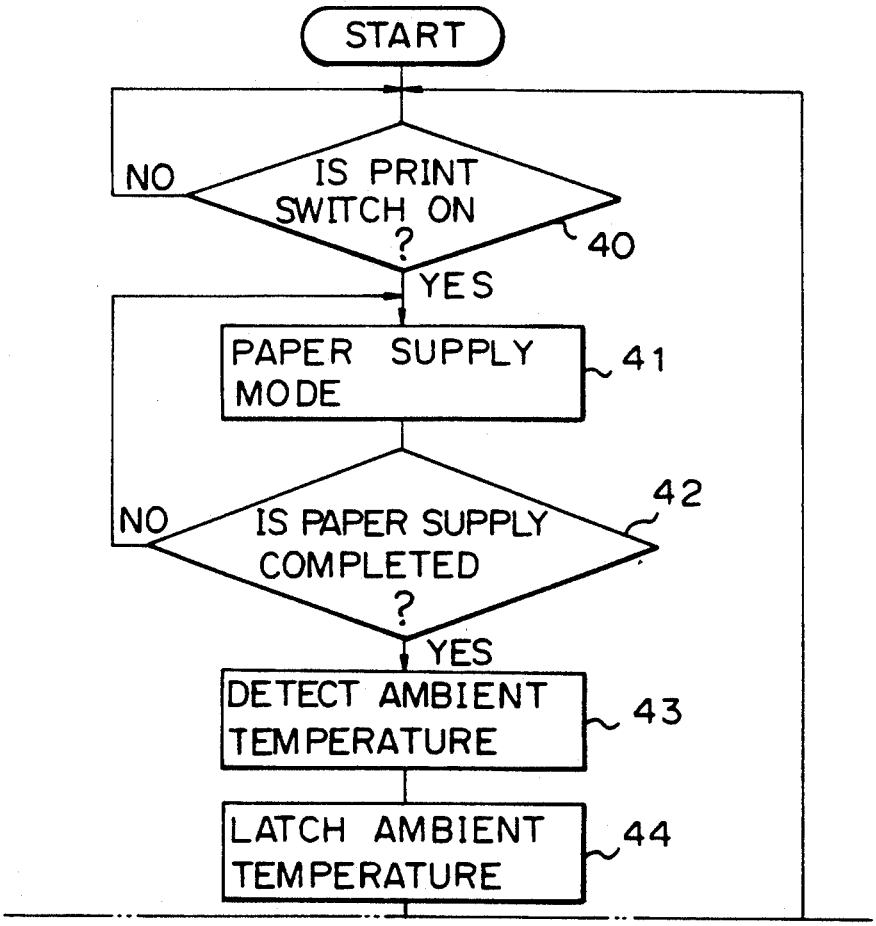
FIG. 8 including
FIGS. 8A and 8B is a flow chart showing an embodiment of the present invention.
Figure 8B:
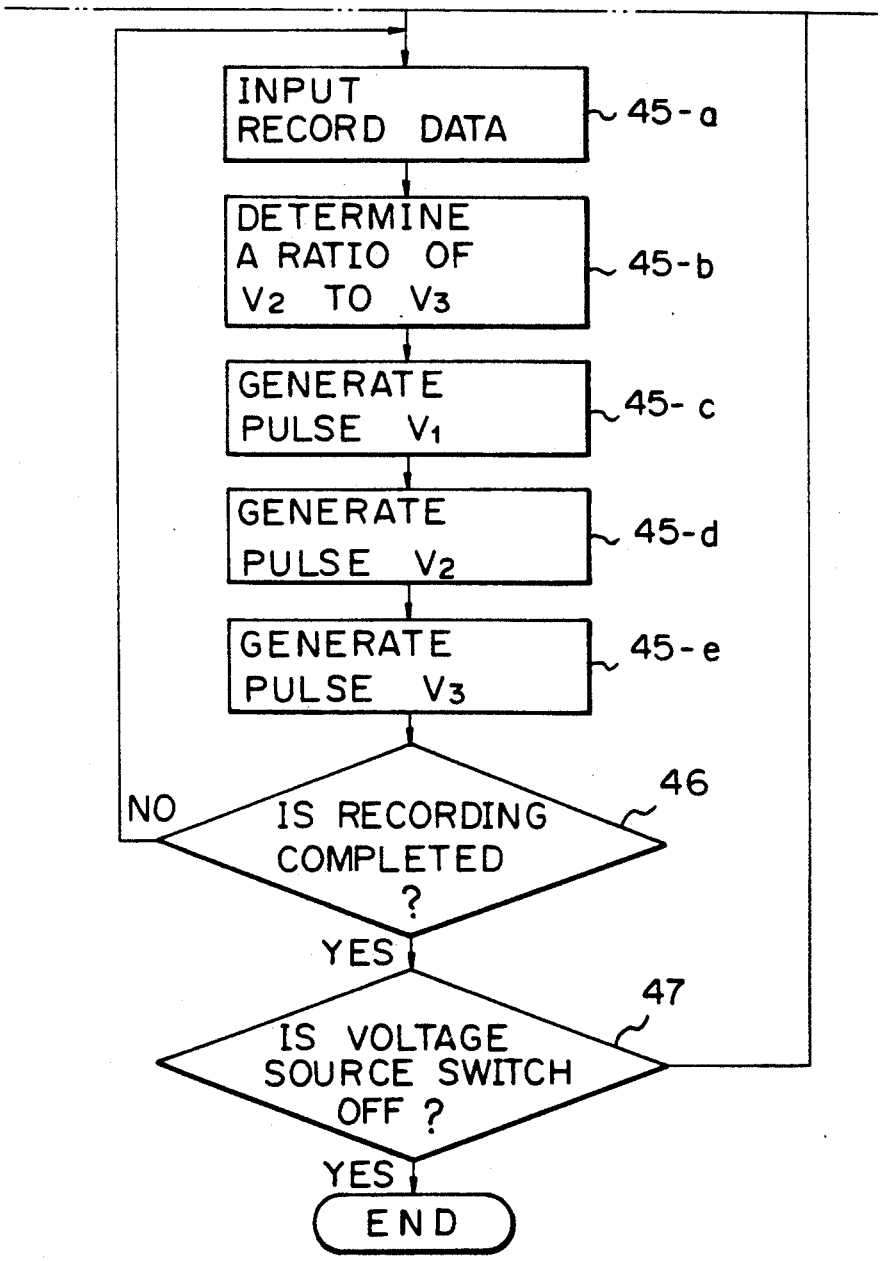

FIG. 7 shows a variation in the amount of retraction of the meniscus when the piezo-electric element is driven by the driving voltages of FIG. 6. As shown in FIG. 7, the amount of retraction $M_R$ of the meniscus becomes greatest immediately after an ink droplet has been discharged from a discharge port 31*a*. At a time T immediately before this, a voltage V3 in the direction of polarization is applied to the piezo-electric element and therefore, the piezo-electric element 32 contracts and pressure is applied in a direction to decrease the amount of retraction of the meniscus. As a result, generation of a second peak as shown in FIG. 5 is prevented and the amount of retraction of the meniscus attenuates smoothly.

Also, the time during which the meniscus restores its steady state has heretofore been about 3000 to 400 μsec., whereas according to the present embodiment, it could be shortened to about 200 μsec. to thereby improve the frequency characteristic of ink injection.

Figure 1:
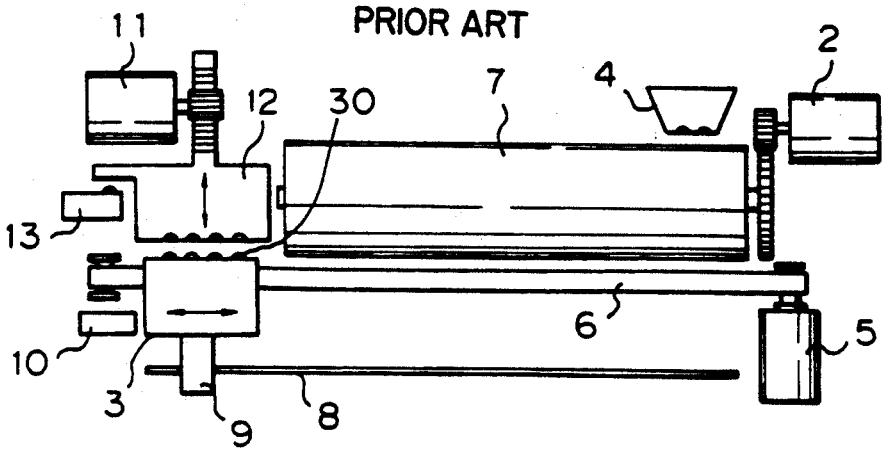
Fig. 1 PRIOR ART
FIG. 1 is a schematic front view showing an example of an ink jet printer constructed by the use of an ink jet recording head.
Figure 2:
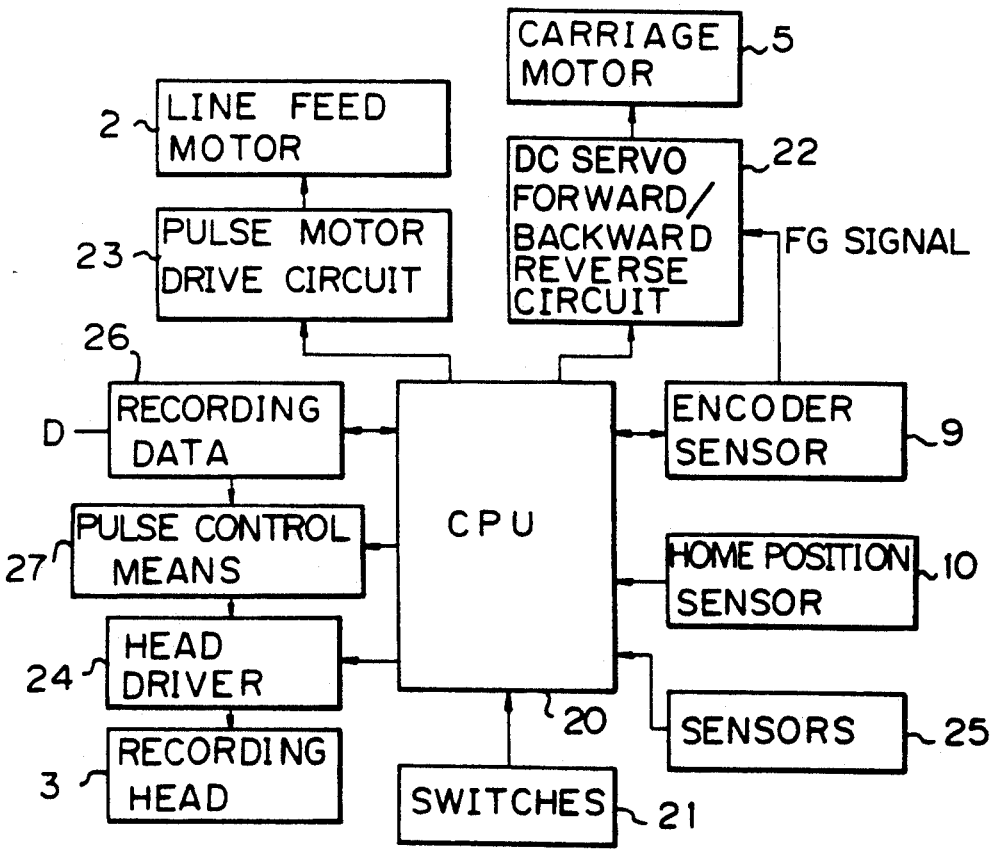
Fig. 2 PRIOR ART
FIG. 2 is a block diagram showing the control system of the ink jet printer of FIG. 1.
Figure 3:
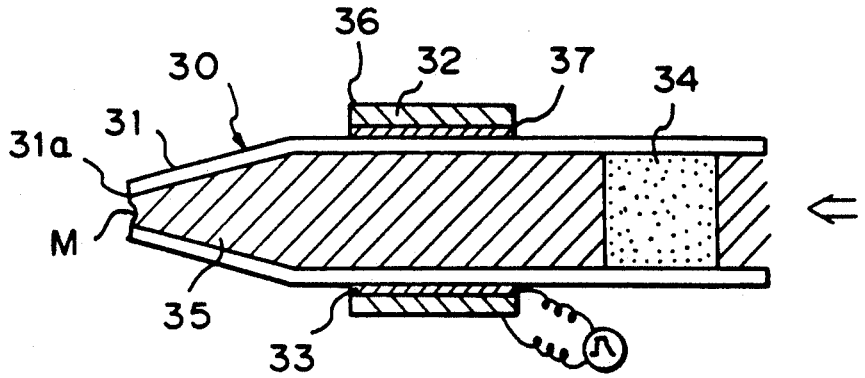
Fig. 3 PRIOR ART
FIG. 3 is a schematic cross-sectional view showing the construction of the liquid paths of the ink jet recording head.

In the present embodiment, pulse control means 27 for controlling the driving pulse in conformity with temperature data and record data is provided as shown in FIG. 2.

A head driver 24 as pulse generating means is designed to generate a driving pulse set by said pulse control means.

The process of FIG. 8 will now be described.

ON/OFF of a print switch is judged at step 40, and if the print switch is ON, the paper supply mode is entered (step 41). Then, at step 42, whether paper supply is completed is judged, and if it is completed, shift is made to the recording mode, and at step 43, the ambient temperature is detected by ambient temperature measuring means in a sensor group 25, and at step 44, the temperature data is latched in a memory in CPU 20 as memory means for the ambient temperature.

When record data is input at step 45-*a*, pulse control means determines the ratio of the magnitudes of the voltages of the main pulse V2 and sub-pulse V3 of the ink discharge wave form as shown in FIG. 6, at step 45-*b*, on the basis of the record data and the latched temperature data. Subsequently, at step 45-*c*, the head driver generates a pulse V1, whereafter at step 45-*d*, it generates a pulse V2 at each predetermined time, and at step 45-*e*, it generates a pulse V3, thereby effecting recording of one dot, and this is repeated until the recording is completed (step 46).

In the meantime, the temperature data remains latched and the value of the ratio of the magnitudes of the voltages of the main pulse and sub-pulse is kept at the value of the ratio determined by the pulse control means. The value of this ratio is smaller as the temperature is higher, and is greater as the temperature is lower, that is, when V1 is constant, V3 is greater as the temperature is higher, and V3 is smaller as the temperature is lower.

Further, in order to accomplish harmonious recording, the ink dot diameter has its size of each dot controlled by the record data 26 printed. This is accomplished by varying the magnitude of the main pulse V2, and at this time, the magnitude of the sub-pulse V3 is varied in conformity with the magnitude of the main pulse V2, whereby the ratio of the magnitudes of the main pulse V2 and the sub-pulse V3 is made constant.

In the present embodiment, control of the driving wave forms of the voltages of the main pulse and sub-pulse for ink discharge is effected by the pulse control means, and the head driver 24 drives the piezo-electric element of the recording head in conformity with the output of the pulse control means.

When recording is completed at step 46, ON or OFF of a voltage source switch is confirmed (step 47). If the voltage source switch is ON, the apparatus is prepared for the next operation of the print switch, and stands by at step 40.

Figure 9:
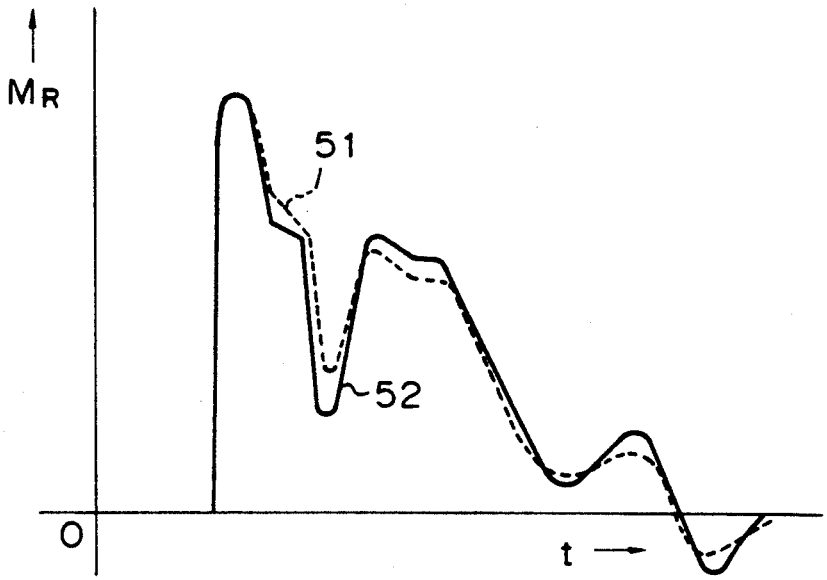
FIG. 9 is a graph showing the comparison between the meniscus vibration during normal temperature and the meniscus vibration during high temperature.

FIG. 9 is a graph showing the comparison between the meniscus vibration during normal temperature and the meniscus vibration during high temperature. The meniscus vibration during normal temperature is such as shown by a characteristic curve 51, whereas during high temperature, the amplitude of the meniscus vibration becomes great as shown by a characteristic curve 52 because the viscosity of the ink is reduced.

Figure 10:
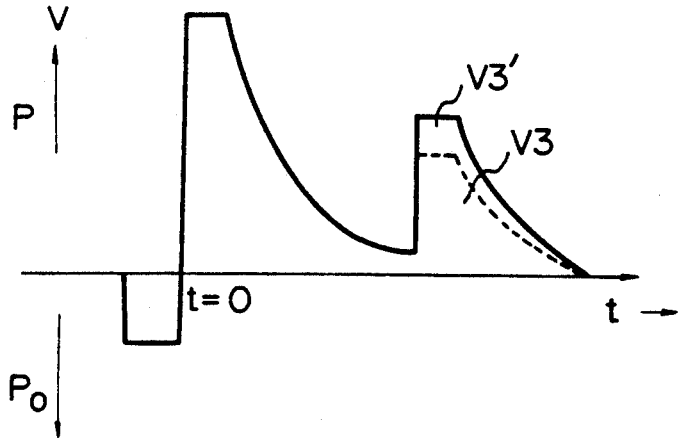
FIG. 10 shows the wave forms of driving voltages for suppressing the meniscus vibration during high temperature.

Application of a driving voltage as shown in FIG. 10 is effective as means for suppressing such an increase in the amplitude of the vibration during high temperature. That is, when the ambient temperature is high, the voltage level of the wave form, V3 is made higher as shown by wave form V3' than that during normal temperature (the wave form V3 indicated by broken line), whereby any variation in the meniscus vibration can be suppressed.

The leakage of ink and the entry of bubbles caused during high temperature can be prevented and also, the voltage of the sub-pulse can be varied in conformity with the voltage of the main pulse. Therefore, appropriate pressure conforming to the meniscus vibration can be applied.

Figure 11:
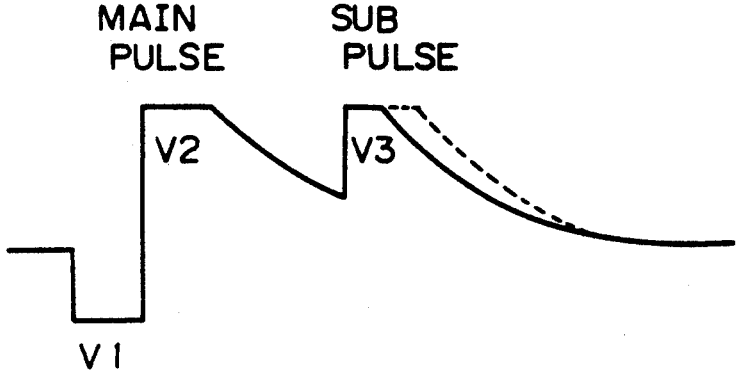
FIG. 11 shows the wave forms of driving voltages for the piezo-electric element in a second embodiment of the present invention.

Accordingly, the meniscus vibration can be suppressed efficiently and ink droplets of a desired dot diameter can be discharged stably. Embodiment 2:

In the first embodiment, the magnitude of the voltages of the main pulse and sub-pulse have been varied to thereby control the ratio of the values of the electric power, but in the second embodiment of the present invention, there is adopted a construction in which, as shown in FIG. 11, the magnitudes of the voltages of the main pulse and sub-pulse are constant and the pulse widths thereof are varied to thereby control the ratio of the values of electric power.

Figures 12, 12A:
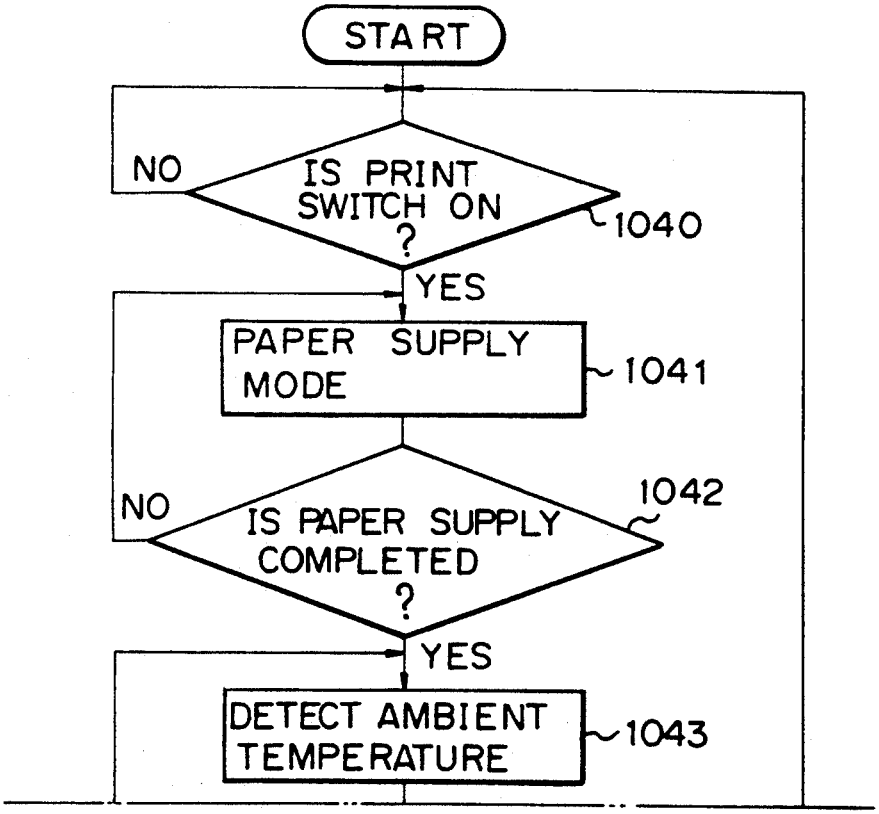
FIG. 12 including
FIGS. 12A and 12B is a flow chart in a second embodiment of the present invention.
Figure 12B:
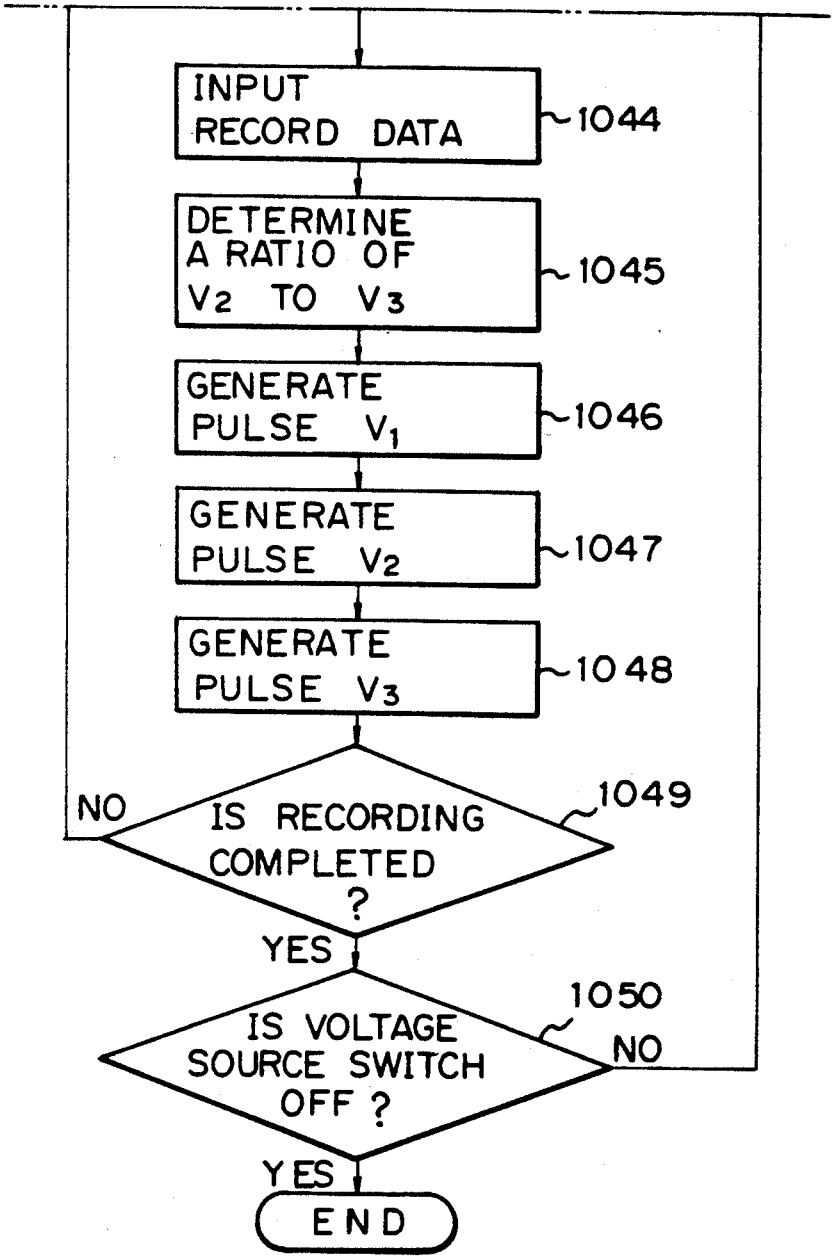

FIG. 12 is a flow chart of the present embodiment. At step 1040, ON/OFF of the print switch is judged, and if the print switch is ON, the paper supply mode is entered at step 1041, where paper supply is effected. At step 1042, whether the paper supply is completed is judged, and if the paper supply is completed, the recording mode is entered. In the recording mode, at step 1043, the ambient temperature is detected and at step 1044, record data is input, whereupon at step 1045, on the basis of the detected temperature data and the record data, the pulse control means determines the value of the ratio of the pulse widths (the ratio of the values of the electric powers) with the values of the voltages of the main pulse V2 and sub-pulse V3 as being constant, as shown in FIG. 11. Subsequently, at steps 1046–1048, the pulses V1, V2 and V3 are generated every predetermined time to thereby effect recording of one dot. In this manner, at steps 1043–1049, recording of one dot is repeated by the driving pulse whose pulse width ratio has been determined on the basis of the temperature data and the record data for each dot until the recording is completed.

According to the present embodiment, each time one dot is recorded, the value of the pulse width ratio can be varied on the basis of the temperature data and the record data. Therefore, even when the change in the environmental conditions is extreme, the meniscus vibration can be suppressed more accurately and timely and leakage of excess ink and entry of bubbles can be prevented.

The piezo-electric element of the recording head according to the present invention is not limited to a cylindrical shape, but may be of a flat shape or any other shape.

The location at which the temperature sensor is provided may be near the liquid path of the recording head or any other portion of the apparatus than the recording head.

In the above-described two embodiments of the present invention, the ratio of the voltages or the pulse widths of the main pulse V2 and the sub-pulse V3 has been controlled on the basis of the temperature data and the record data, but a similar effect has been obtained by varying both the voltages and the pulse widths of the main pulse and the sub-pulse to thereby control the ratio of the values of electric power.

Also, in the present invention, control of the value of the ratio of the values of electric power, (the magnitudes) of the pulses may be such control that the value of said ratio is determined during the recording of each character of each line.

The pulse control means in the present invention may be of a unitary type in which it is incorporated as a circuit in the head driver or of a type in which a CPU itself comprises the pulse control means.

As is apparent from the foregoing description, according to the present invention, subsequent to the main pulse, a pulse of an appropriate value of electric power smaller than or equal to the main pulse and of the same polarity as the main pulse is generated. Therefore, the meniscus vibration occurring near the orifice leading to the liquid path can be suppressed and the leakage of the ink from the discharge port during the another time other than the discharge driving and the entry of bubbles can be prevented, whereby stable and good recorded images can always be obtained.

Also, the time required for the meniscus to restore its steady state is shortened and therefore, the timing of ink injection can be quickened. Thus, high-speed recording can be realized.

Further, the meniscus vibration can be appropriately suppressed in conformity with ambient temperature or the like. Therefore, stable and good recorded images can be obtained and particularly, when effecting harmonious recording in which the ink dot diameter is controlled, excellent recorded images can be obtained.

We claim:

1. An ink jet recording apparatus comprising:

a recording head including a liquid path and a discharge port for discharging ink therethrough;

an electromechanical conversion element associated with said liquid path for effecting ink discharge by deforming in a predetermined direction; and control means for controlling said element by performing a first step of supplying a pre-discharge electrical signal to deform said element in a direction opposite said predetermined direction, a second step, performed after said first step, of supplying a main electrical signal having a first voltage to deform said element in the predetermined direction in accordance with a recording signal, and a third step, performed after ink is discharged by said second step, of supplying a subsequent electrical signal having a second voltage not greater than the voltage of the main electrical signal to deform said element in the predetermined direction to inhibit meniscus retraction, the subsequent electrical signal being supplied before the voltage of the main electrical signal returns to zero, wherein the subsequent electrical signal smoothly changes and quickly attenuates vibration of the meniscus caused by deformation of said element by the main electrical signal and said control means controls the voltage of the subsequent electrical signal by varying a ratio between the voltage of the subsequent electrical signal and the voltage of the main electrical signal when the main electrical signal varies to control the recording quality.

2. An ink jet recording apparatus comprising:

a recording head including a liquid path and a discharge port for discharging ink therethrough;

an electromechanical conversion element associated with said liquid path for effecting ink discharge by deforming in a predetermined direction;

temperature detecting means for detecting a temperature condition in relation to a predetermined temperature condition; and control means for controlling said element by performing a first step of supplying a pre-discharge electrical signal to deform said element in a direction opposite said predetermined direction, a second step, performed after said first step, of supplying a main electrical signal having a first voltage to deform said element in the predetermined direction in accordance with a recording signal, and a third step, performed after ink is discharged by said second step, of supplying a subsequent electrical signal having a second voltage not greater than the voltage of the main electrical signal to deform said element in the predetermined direction to inhibit meniscus retraction, the subsequent electrical signal being supplied before the voltage of the main electrical signal returns to zero, wherein the subsequent electrical signal smoothly changes and quickly attenuates vibration of the meniscus caused by deformation of said element by the main electrical signal and said control means increases the voltage of the subsequent electrical signal in accordance with the amount by which the temperature condition detected by said temperature detecting means is higher than the predetermined temperature condition.

3. An ink jet recording apparatus in which an electrical signal is supplied to an electromechanical conversion element correspondingly provided on a liquid path to thereby discharge ink from a discharge port communicating with said liquid path to thereby accomplish recording, said apparatus comprising:

means for supplying a main electrical signal having a predetermined voltage to drive the conversion element;

sub-electrical signal supplying means for supplying a subsequent electrical signal having a predetermined power to the conversion element, after the main electrical signal is supplied, for stabilizing meniscus vibration, the subsequent electrical signal being supplied before the voltage of the main electrical signal returns to zero;

detecting means for detecting ambient temperature; and control means for controlling the power of the subsequent electrical signal in accordance with the temperature detected by said detecting means, wherein the power of the subsequent electrical signal is increased in response to an increase in ambient temperature.

* * * * *